US005310257A

United States Patent [19]

Altieri, Jr. et al.

[11] Patent Number: 5,310,257

[45] Date of Patent: May 10, 1994

[54] MIXING APPARATUS

[75] Inventors: Anthony Altieri, Jr., Wheeling; Melvin F. Sass, Park Ridge, both of Ill.

[73] Assignee: Fluid Management Limited Partnership, Wheeling, Ill.

[21] Appl. No.: 968,389

[22] Filed: Oct. 29, 1992

[51] Int. Cl.[5] ..... B01F 9/00

[52] U.S. Cl. ..... 366/208; 366/217; 366/219; 100/219; 269/167; 269/169

[58] Field of Search ..... 366/214, 208, 209, 219, 366/210, 211, 213, 217; 188/67; 74/531; 269/166, 167, 168, 169, 170, 171; 87/92, 93; 254/93 R; 100/219

[56] References Cited

U.S. PATENT DOCUMENTS

| | | | |
|---|---|---|---|
| 869,246 | 10/1907 | Jones . | |
| 872,943 | 12/1907 | Jones . | |
| 904,371 | 11/1908 | Stewart . | |
| 1,030,854 | 6/1912 | Percy . | |
| 1,270,835 | 7/1918 | Jersemann . | |
| 1,641,280 | 9/1927 | Joslin et al. . | |
| 1,836,879 | 12/1931 | Selig et al. . | |
| 1,959,694 | 5/1934 | Stevens . | |
| 2,185,277 | 1/1940 | Stelzer . | |
| 2,207,139 | 7/1940 | Weightman . | |
| 2,281,094 | 4/1942 | Chambers . | |
| 2,354,573 | 7/1944 | Brock . | |
| 2,362,067 | 11/1944 | Heinrich | 269/169 |
| 2,416,581 | 2/1947 | Harr . | |
| 2,428,035 | 9/1947 | Palm . | |
| 2,536,277 | 1/1951 | Grieme . | |
| 2,606,696 | 8/1952 | Miner . | |
| 2,619,116 | 11/1952 | Ralston . | |
| 2,645,401 | 7/1953 | Kerr . | |
| 2,654,505 | 10/1953 | Fuhrman . | |
| 2,665,825 | 1/1954 | Poitras et al. . | |
| 2,675,760 | 4/1954 | Hall . | |
| 2,675,946 | 4/1954 | Strempel . | |
| 2,684,804 | 7/1954 | Huntar et al. . | |
| 2,735,323 | 2/1956 | Phillips | 269/167 |
| 2,786,419 | 3/1957 | Lynn . | |
| 2,821,172 | 1/1958 | Randall . | |
| 2,843,044 | 7/1958 | Mashinter . | |
| 2,905,361 | 9/1959 | Noall . | |
| 2,913,965 | 11/1959 | Collis | 269/166 |
| 2,940,724 | 6/1960 | Sieling . | |
| 3,015,415 | 1/1962 | Marsh et al. . | |
| 3,023,936 | 3/1962 | Marsh et al. . | |
| 3,042,310 | 7/1962 | Franke et al. . | |
| 3,068,650 | 12/1962 | Phillips . | |
| 3,242,881 | 3/1966 | Schafer . | |
| 3,349,962 | 10/1967 | Levin . | |
| 3,390,815 | 7/1968 | Kavan et al. . | |
| 3,426,945 | 2/1969 | Harriman . | |
| 3,545,680 | 12/1970 | Ottaway . | |
| 3,589,610 | 6/1971 | Wahlin et al. . | |
| 3,791,590 | 2/1974 | Dieter . | |
| 3,830,405 | 8/1974 | Jaeger . | |
| 3,854,629 | 12/1974 | Blieberger . | |
| 3,890,922 | 6/1975 | Nordenholt . | |
| 3,895,748 | 7/1975 | Klingenberg . | |
| 3,913,797 | 10/1975 | Brym . | |

(List continued on next page.)

FOREIGN PATENT DOCUMENTS

| | | |
|---|---|---|
| 419383A1 | 3/1991 | European Pat. Off. . |
| WO87/05537 | 9/1987 | PCT Int'l Appl. . |
| WO87/05697 | 9/1987 | PCT Int'l Appl. . |
| 1310655 | 3/1973 | United Kingdom . |

*Primary Examiner*—Harvey C. Hornsby
*Assistant Examiner*—Reginald L. Alexander
*Attorney, Agent, or Firm*—Fitch, Even, Tabin & Flannery

[57] ABSTRACT

A clamping fixture slides between a pair of guide rails and includes a pressure plate between the guide rails. Lock plates with internal openings for receiving the guide rails are held captive on the pressure plate. An operating bar with stepped ends, one adjacent each locking plate, is deflected by a cam mechanism to incline the lock plates relative to the guide rails, thus wedging the lock plates to prevent further sliding along the guide rails. Return springs are provided to urge the lock plates to an unlocked position when pressure on the operating bar is released. A mixing apparatus using the clamping fixture is also disclosed.

25 Claims, 3 Drawing Sheets

U.S. PATENT DOCUMENTS 3,913,801 10/1975 Wise et al. .
3,932,065 1/1976 Ginsberg et al. .
3,937,440 2/1976 MacGregor et al. .
3,963,377 6/1976 Elliott et al. .
3,979,172 9/1976 Sogo et al. .
4,004,717 1/1977 Wanke .
4,043,764 9/1977 Repplinger .
4,046,287 9/1977 Hoekstra et al. .
4,047,849 9/1977 Clay .
4,053,012 10/1977 Farmer .
4,105,146 8/1978 Broillard .
4,119,058 10/1978 Schmermund .
4,134,689 1/1979 Ahrenskou-Sorenson ..... 366/110
4,142,707 3/1979 Bjorklund .
4,150,769 4/1979 James .
4,155,490 5/1979 Glenn .
4,212,413 7/1980 Barber, Jr. et al. .
4,257,321 3/1981 Wheeler et al. ..... 100/219
4,265,613 5/1981 Oppenberg .
4,291,868 9/1981 Giles ..... 269/167
4,314,653 2/1982 Sindoni .
4,350,477 9/1982 Mazal .
4,363,429 12/1982 Schindler .
4,371,096 2/1983 Scholl et al. .
4,394,945 7/1983 Taylor, Jr. .
4,410,108 10/1983 Minard .
4,488,845 12/1984 Dupré ..... 100/219
4,516,702 5/1985 Schmidt .
4,519,526 5/1985 Hillman .
4,526,215 7/1985 Harrison et al. .
4,588,302 5/1986 Pizzi et al. ..... 366/209
4,597,719 7/1986 Tano .
4,607,998 8/1986 Hawkes .
4,615,902 10/1986 Falcoff et al. .
4,648,810 3/1987 Schippers et al. .
4,653,813 3/1987 Burgdorf .
4,789,245 12/1988 Morbeck ..... 366/217
4,834,548 5/1989 Tempel et al. ..... 366/208
4,878,601 11/1989 Flemming et al. .
4,946,100 8/1990 Flemming et al. .
4,966,467 10/1990 Johnson ..... 366/209
5,083,591 1/1992 Edwards et al. .

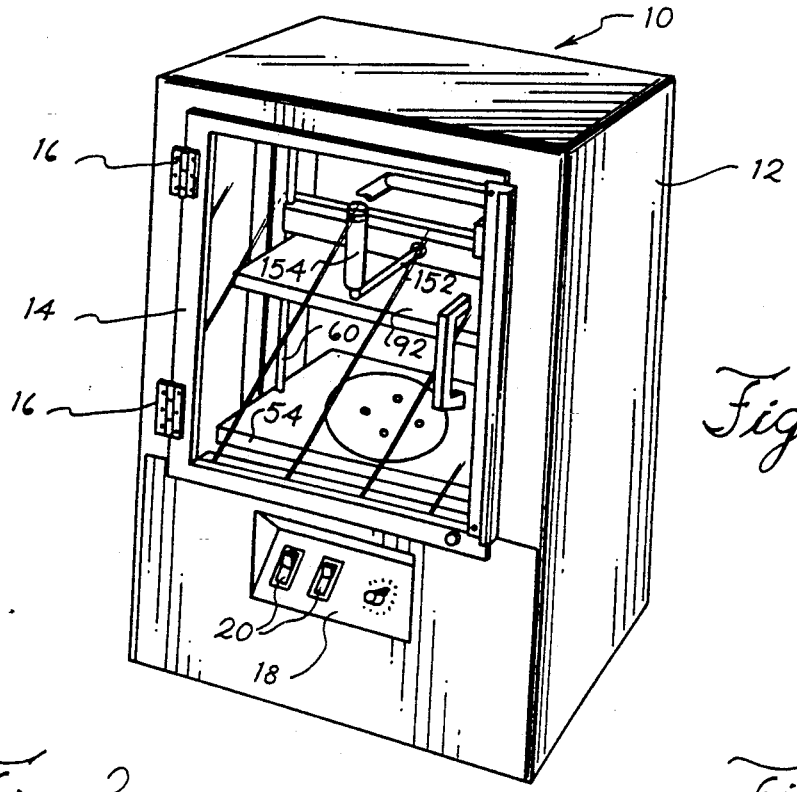
Fig. 1
Fig. 2
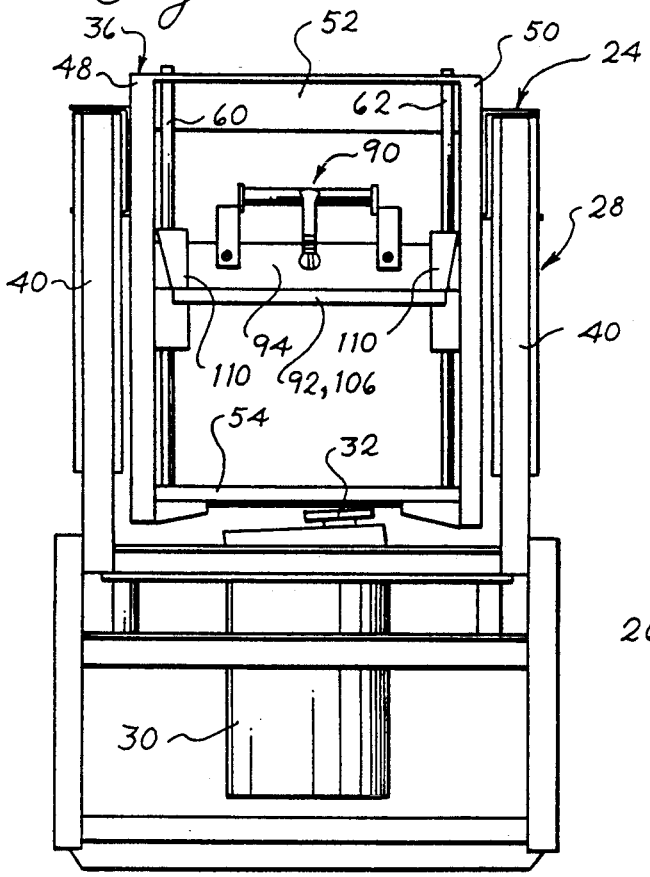
Fig. 3
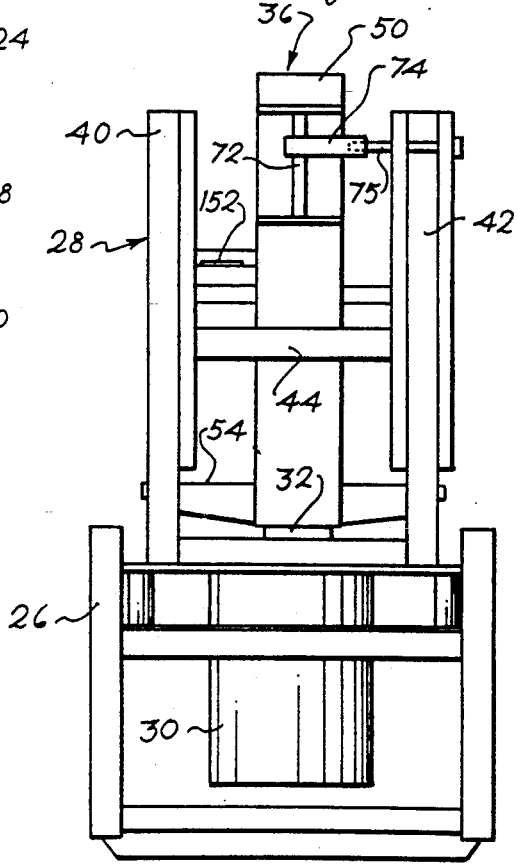

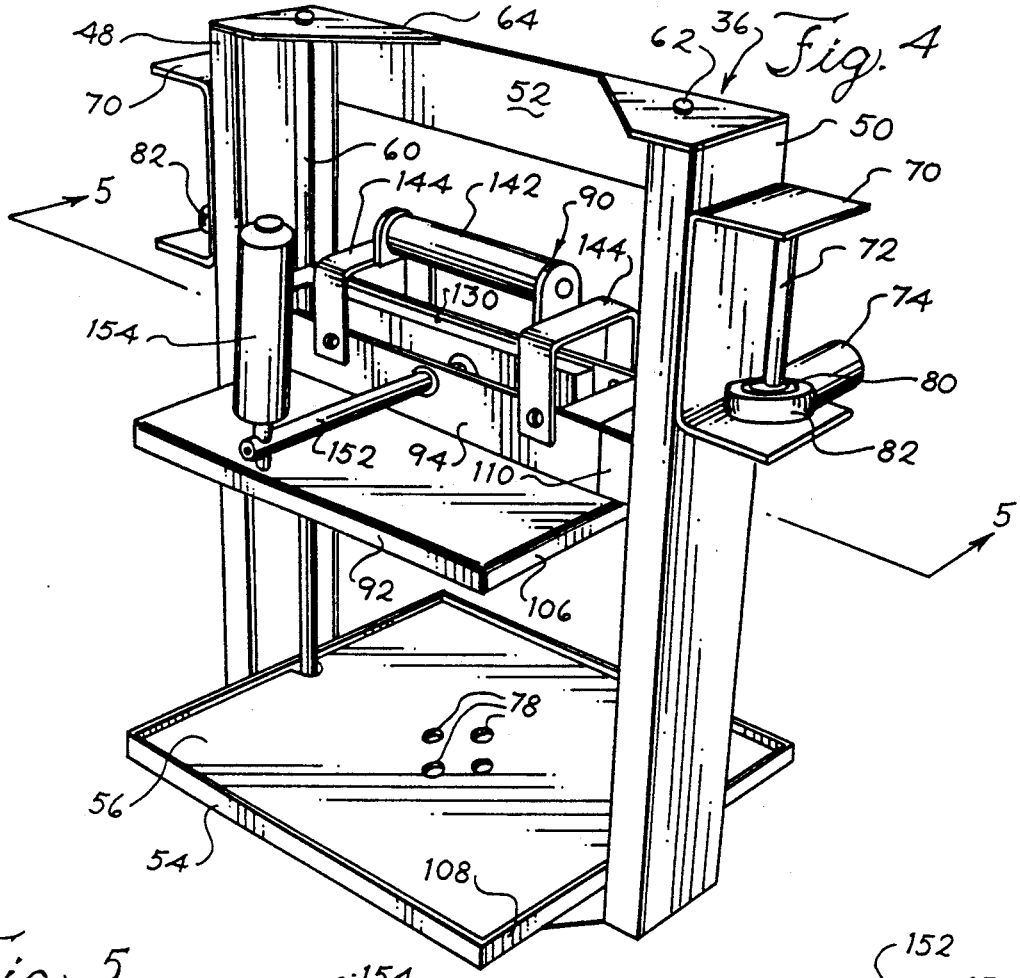
Fig. 4
Fig. 5
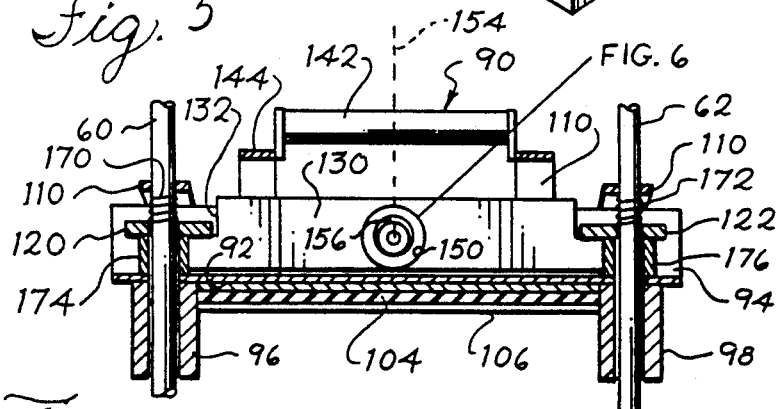
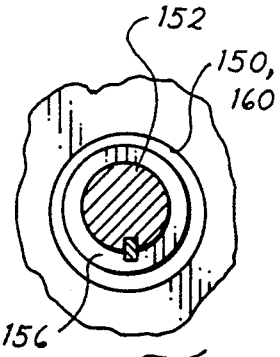
Fig. 6
Fig. 7
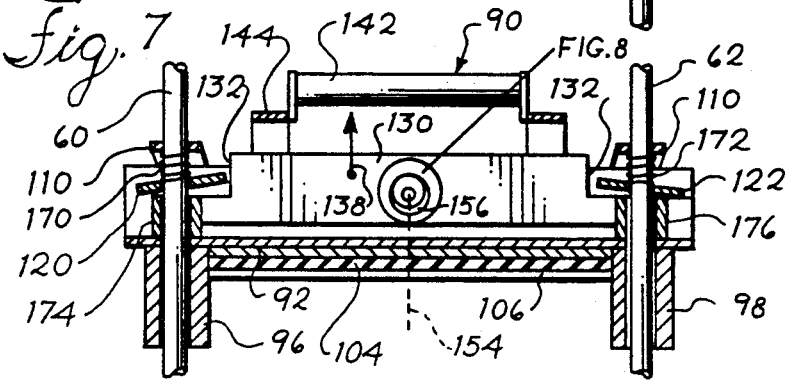
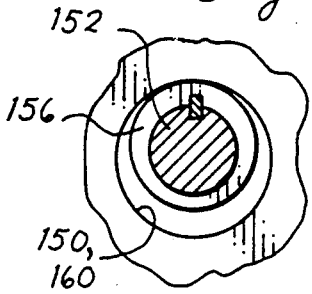
Fig. 8

MIXING APPARATUS

BACKGROUND OF THE INVENTION

1. Field of the Invention

The present invention pertains to apparatus for mixing liquid and pulverulent materials, and especially to mixing apparatus having a clamp plate for securing a container.

2. Description of the Related Art

An increasing variety of products offered for sale today are made available in slightly different compositions, requiring mixing at the point of sale to complete preparation of the product. For example, paint and paint products are mixed at the point of sale to provide a particular color chosen by the customer. This typically involves mixing a small quantity of tints or colorants in a much larger quantity of a relatively colorless base material. Thorough mixing of the colorants and base material is required to assume uniform color characteristics throughout the resulting paint product.

A variety of vibratory mixers have been proposed for use either at a manufacturing site or at points of sale. One particularly successful vibratory mixer is disclosed in U.S. Pat. No. 4,834,548 which vibrates a container clamped in the apparatus in a generally conical motion. The mixing motion has been found to be quite successful in producing uniform paint compositions. However, improvements have been desired in miniaturizing the apparatus and improving the clamping arrangement employed.

U.S. Pat. No. 4,134,689 discloses mixing apparatus having a different, vibratory motion with an inner frame driven from below by horizontally oriented cam members. A clamping plate is provided for the inner frame, by a pair of twin lead screws driven from above by a transmission shaft. The clamping plate travels up and down along the lead screws, as the lead screws are rotated. The twin lead screw design is costly to manufacture and adds to the weight of the mixing apparatus. Improvements in weight decrease for small, countertop units have prompted investigations for other mixer designs.

U.S. Pat. No. 4,789,245 discloses a disc-type mixing apparatus having a crank-operated clamping plate. The clamping plate and associated mechanism are attached to a rotating disc, leading to a relatively large, bulky package unsuitable for some applications such as a countertop mixing unit. British Pat. No. 1 310 655 discloses a mixing apparatus having a clamping plate moved up and down by an operating rod attached to the plate. The rod passes through a frame member to which a quick-locking device is mounted. The locking device is actuated by a horizontal shaft which is rotated about the rod between unclamped and clamped positions. The clamping plate is supported at the center by a single rod to which a clamping force is applied to maintain the pressure plate in a fixed position. It is desired to provide a quick-acting pressure plate clamped at least two spaced apart points.

SUMMARY OF THE INVENTION

It is an object according to the present invention to provide an improved paint mixing apparatus of compact size and light weight.

Another object according to principles of the present invention is to provide a paint mixing apparatus having an improved clamping arrangement.

A further object according to the present invention is to provide an improved clamping arrangement for use with paint mixers and other devices which travels along a pair of guide rails and is clamped to the guide rails with a relatively simple, quick-acting locking arrangement.

Yet another object according to the present invention is to provide a clamping arrangement which applies a defined preselected pressure to an object being clamped.

These and other objects according to principles of the present invention are provided in a clamping fixture for slidable mounting between a pair of generally parallel spaced apart guide rails, comprising:

a pressure plate insertable between said guide rails;

at least two lock plates movably attached to the pressure plate, one lock plate for each guide rail, each lock plate including a locking edge defining an aperture for receiving a respective guide rail so as to slide along the guide rail;

a bar extending between said lock plates, said bar having end portions for engaging said lock plates, with a central, cam-engaging portion therebetween;

an operating shaft movable between locked and unlocked positions, and having a cam mounting portion adjacent said central portion;

cam means mounted on the cam mounting portion and engaging the cam-engaging portion; and displacement of said operating shaft moving said cam to displace the bar and move the lock plates so as to bring the locking edges into binding engagement with the guide rails to prevent movement of the pressure plate with respect to the guide rails.

Other objects according to the present invention are provided in mixing apparatus using the above clamping arrangement. The mixing apparatus includes:

a pair of parallel spaced apart guide rails;

a frame supporting said guide rails;

a pressure plate insertable between said guide rails;

at least two lock plates movably attached to the pressure plate, one lock plate for each guide rail, each lock plate including a locking edge defining an aperture for receiving a respective guide rail so as to slide along the guide rail;

a bar extending between said lock plates, said bar having end portions for engaging said lock plates, with a central, cam-engaging portion therebetween;

an operating shaft movable between locked and unlocked positions, and having a cam mounting portion adjacent said central portion;

cam means mounted on the cam mounting portion and engaging the cam-engaging portion; and displacement of said operating shaft moving said cam to displace the bar and move the lock plates so as to bring the locking edges into binding engagement with the guide rails to prevent movement of the pressure plate with respect to the guide rails.

BRIEF DESCRIPTION OF THE DRAWINGS

FIG. 1 is a perspective view of mixing apparatus according to principles of the present invention;

FIG. 2 is a front elevational view thereof with the outer cabinet removed, showing the internal mechanism;

FIG. 3 is a side elevational view of the internal mechanism;

FIG. 4 is a perspective view of the clamping mechanism thereof;

FIG. 5 is a fragmentary cross-sectional view taken along the line 5—5 of FIG. 4;

FIG. 6 is a fragmentary, cross-sectional view showing a portion of FIG. 5 on an enlarged scale;

FIG. 7 is a view similar to that of FIG. 5, but showing the clamping mechanism in a locked position;

FIG. 8 is a fragmentary, cross-sectional view showing a portion of FIG. 7 on an enlarged scale.

DETAILED DESCRIPTION OF THE PREFERRED EMBODIMENT

Figure 9:
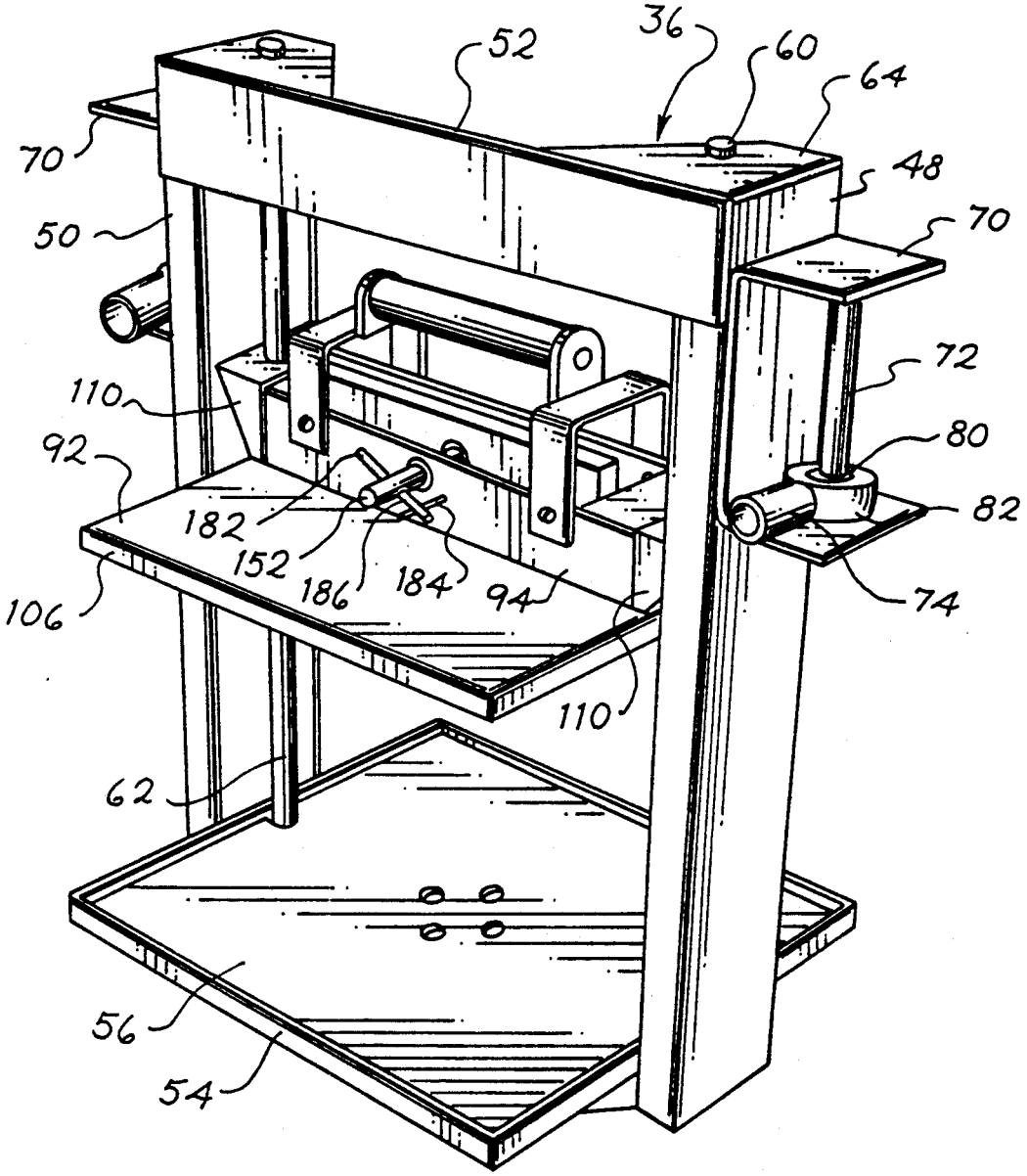
FIG. 9 is a perspective view showing the rear portion of the clamping apparatus of FIG. 4.

Referring now to FIG. 1, a mixer is generally indicated at 10, and includes an outer cabinet 12 with a door 14 mounted to the cabinet by hinges 16. A control panel 18 includes switches 20 for controlling operation of the electric motor and the mixing mechanism driven thereby.

The mixing mechanism generally indicated at 24 and disposed within cabinet 12, is illustrated in FIGS. 2 and 3. The mixing mechanism 24 includes a base 26 and an outer frame 28. An electric motor 30 is mounted on base 26, and drives a crank 32 which is mounted to an inner frame generally indicated at 36. Referring to FIG. 4, for example, apertures 78 are formed in resilient pad 56, to allow access to mounting bolts securing bottom plate 54 to crank 32.

As can be seen in FIG. 3, the outer frame 28 has a generally H-shaped configuration with upright members 40, 42 and a cross member 44. The inner frame 36 includes side members 48, 50 and an upper cross member 52. The bottom plate 54 spans the side members 48, 50 and includes a resilient cushion 56. As can be seen in the perspective view of FIG. 4, and in FIGS. 5 and 7, the inner frame 36 further includes a pair of spaced-apart guide rails 60, 62 which extend the length of side members 48, 50, having upper ends secured to portion 64 of cross member 52.

Referring again to FIG. 4, mounting brackets 70 are attached at the upper ends of side members 48, 50. Shafts 72 are mounted in brackets 70, spaced from the side members. Bushing members 74 are held captive on shafts 72, for relative sliding movement of the shafts with respect to the bushing members. As shown in FIG. 3, the bushing members 74 are secured to the rear uprights 42 of outer frame 28 by threaded rods 75. The bushing members 74 are thus fixedly secured to the outer frame, and guide the upper portion of inner frame 36 as the inner frame is vibrated by the action of motor-driven crank 32. The bushing members 74 preferably include an inner bearing member 80, which not only slides along shafts 72 with a reciprocal linear motion, but which also swivels or pivots within the outer body 82 of bushing members 74. Thus, with reference to FIG. 3, for example, the inner frame 36 can be inclined at angles to the vertical under the action of crank 32, which displaces the bottom portion of inner frame 36 with a front-to-back, lateral motion.

The crank also displaces the bottom portion of inner frame 36 in a side-to-side lateral motion as viewed in the front elevational view of FIG. 2. In effect, the bottom plate 54 is displaced in a generally horizontal, circular motion while the top portion of inner frame 36 is generally constrained by bushing members 74 and shafts 72. The motion of inner frame 36 is generally conical, the same as that disclosed in U.S. Pat. No. 4,834,548, the disclosure of which is incorporated by reference as if fully set forth herein. The bushing members and shafts 74, 72 have been substituted for the resilient tubes or parallel rubber elements of U.S. Pat. No. 4,834,548, but have been found to preserve the motion described in the Patent.

Referring additionally to FIGS. 5-8, a clamping fixture generally indicated at 90 is mounted for sliding along guide rails 60, 62. The clamping fixture 90 includes an upper, moveable pressure plate 92 mounted to a transverse body portion 94 of generally U-shaped cross-section. Collar-like bushing members 96, 98 are secured to body 94 (and also preferably to pressure plate 92) and provide stability for body 94 to prevent the body from cocking or wedging between the guide rails 60, 62 as the clamping fixture is reciprocated about the guide rails.

The clamping plate 92 also includes a resilient padding 104, similar to the resilient padding 56. Preferably, the moveable pressure plate 92 includes a downturned lip 106 which complements the upturned lip 108 of the stationary bottom plate 54. The lips 106, 108 help locate one or more containers to be clamped between the pressure plates. The clamp fixture and mixing apparatus according to principles of the present invention has found immediate commercial acceptance in the retail paint industry and is used to mix paint formulations within sealed containers placed between the clamping plates 54, 92. The resilient padding 56, 104 improves the gripping engagement of the plates with a paint container, and as will be seen herein, provides a convenient, preselected clamping pressure.

Referring to FIGS. 2 and 5, body member 94 has upper guide members 110 which include apertures for receiving the guide rails 60, 62. The upper guide members 110 and body 94 cooperate to partially enclose lock plates 120, 122, which define apertures 124, 126 respectively for receiving guide rails 60, 62. The clamping fixture 90 further includes an operating bar 130 having stepped ends 132, 134 for engaging the inner ends of lock plates 120, 122. As will be seen herein, the operating bar 130 is moved in generally vertical directions between the positions shown in FIGS. 5 and 7, so as to operate the lock plates 120, 122 between locked and unlocked positions. For example, the operating bar 130 is lifted in the direction of arrow 138 to move the locking plates 120, 122 to the locked position of FIG. 7, once the clamping fixture is manually moved into position along guide rails 60, 62, using a handle 142 secured to body 94 with brackets 144. For example, the clamping fixture may be raised to allow the container to be inserted between pressure plates 54, 92, and thereafter lowered until the upper pressure plate 92 rests against the container, under the weight of the clamping fixture. The locking mechanism is then activated which increases the clamping pressure to a preselected level.

Referring especially to FIGS. 5-8, the operating bar 130 defines a central aperture 150 which receives a shaft 152 which is rotated about its central axis by a manually engageable operating lever 154. A cam member 156 is mounted on shaft 152 for movement between the positions illustrated in FIGS. 4 and 8 as operating lever 154 is moved between the positions shown in FIGS. 5 and 7, respectively. Cam member 156 is located so as to contact the internal bore wall 160 defining aperture 150.

As lever 154 is lowered to the position illustrated in FIG. 7, the high point of the cam member 156 is moved to a vertical position, engaging bore wall 160 and raising operating bar 130 to a maximum height. This raises the stepped ends 132, 134 of operating bar 130 to a maximum height, so as to raise the inner, opposed ends of lock plates 120, 122, causing the lock plates to become cocked or tilted so as to wedge or otherwise interfere with the guide rails 60, 62. The bore wall of lock plates 120, 122 defining the apertures for receiving guide rails 60, 62 preferably wedges against the guide rails, preventing sliding movement of the lock plates with respect to the guide rails.

Alternatively, bar 130 can be raised by a linear, reciprocal cam motion. For example, a ft 152 could be provided with a sharpened or wedge-shaped tip telescopically insertable in aperture 150 to press against bore wall 160 as the shaft is translated in the direction of its central axis. Other wedging actions initiated by translation movement are also possible, and will become apparent to those skilled in the art. Thus, non-rotating actuation of bar 130 is possible, and may be preferred in some applications.

In the preferred embodiment, coil springs are employed to maintain the lock plates in a generally horizontal, maximum-clearance position with respect to the guide rails 60, 62. In the preferred embodiment, a pair of coil springs are provided for each lock plate. For example, coil springs 170, 172 are mounted on guide rails 60, 62 above lock plates 120, 122, respectively. Coil spring 170 is held captive between lock plate 120 and guide member 110. Similarly, coil spring 170, 172 is held captive between the lock plate 122 and the guide member 110. Rigid spacers 174, 176 are mounted on guide rails 60, 62 below lock plates 120, 122, respectively. As shown in FIGS. 5 and 7, the coil springs 170, 172 are deflected as operating bar 130 displaces the locking plates 120, 122 from positions generally normal to the central axis of the guide rails about which they are mounted. It should be noted that both lock plates are actuated in a substantially simultaneous fashion, as a force is applied to the operating bar 130, at a point approximately midway between the lock plates. If desired, bias means of various types may be substituted for the coil springs. For example, belleville washers, wave washers or elastomeric pads may be used.

According to another aspect of the present invention, as the lock plates are displaced in the manner illustrated in FIG. 7, the clamping fixture 90 is displaced a small amount in a downward direction, thus increasing pressure applied to a container to a carefully controlled, preselected amount. Further, the amount of preload pressure can be made uniform from one operation to another, virtually insensitive to an operator's manipulation of the clamping fixture. Thus, even with a variety of different operators, as may be expected where multiple salesmen are employed at a store location, a consistent, carefully controlled preload pressure can be applied to a container prior to a mixing operation. This presents significant advantages by reducing waste associated with damaged containers. Further, since the preset pressure is attained by operating manual lever 154 to apply displacement to a cam member, a significant mechanical advantage is provided by the clamping fixture, which allows operators having different manual strength to easily attain the desired preset loading on a container.

Turning now to FIG. 9, the preferred clamping fixture according to principles of the present invention, includes stop pins 182, 186 which interfere with stationary pin 184 to limit rotation of shaft 152. Stop pin 182, preferably mounted on shaft 152, defines the maximum clamping preload pressure by effectively limiting the angular offset of cam 156 which can be obtained by turning operating lever 154. Pin 186, also affixed to shaft 152, limits rotation of the shaft. If desired, the stop pins 182, 186 can be repositioned about operating shaft 152, so as to vary the angular range of motion of cam 156. For example, stop pin 182 can be moved so as to limit the clamping force generated by turning shaft 152. By restricting the displacement of shaft 152, the displacement of operating bar 130, and of locking plates 120, 122 is also reduced, thus lowering the preload pressure applied by the clamping fixture to a container. If desired, the location of the stationary pin 184 can be adjusted to change the rotation limits imposed on shaft 152.

After a mixing operation is completed, the operating lever 154 is moved to the position illustrated in FIG. 5, so as to release lock plates 120, 122 allowing the lock plates to return to their unlocked position under the bias force of springs 170, 172. The clamping fixture is then manually raised by grasping handle 142, so as to slide the clamping fixture about guide rails 60, 62. It is preferred that handle 142 be mounted so as to straddle each end of operating bar 130, thus being attached to body 94 at four points, two of which are located at the forward side of body 94 (that side visible in FIG. 4) and two points located at the opposed, rearward side of body 94 (visible in FIG. 9). This handle design has been found to reliably prevent "cocking" of the clamping fixture, as it is reciprocated about guide rails 60, 62. The axial separation between upper guide members 110 and bushing members 96, 98 also aids in preventing unintentional jamming as the clamping fixture is moved up and down.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following Claims.

We claim:

1. Clamping fixture for slidable mounting between a pair of generally parallel spaced apart guide rails, comprising:

a pressure plate insertable between said guide rails;

at least two lock plates adjacent aperture for receiving a respective guide rail so as to slide along the guide rail, said aperture having a locking edge;

a bar extending between said lock plates, said bar having end portions for engaging said lock plates, with a central, cam-engaging portion therebetween;

an operating shaft movable between locked and unlocked positions, and having a cam mounting portion adjacent said central portion;

cam means mounted on the cam mounting portion and engaging the cam-engaging portion;

the cam-engaging portion of said bar including edge means defining an aperture for receiving the cam mounting portion of said operating shaft with said cam means engaging said edge means to displace said bar; and displacement of said operating shaft moving said cam to displace the bar and move the lock plates so as to bring the locking edges into binding engagement with the guide rails to prevent movement of the pressure plate with respect to the guide rails.

2. The fixture of claim 1 further comprising mounting means for mounting said pressure plate for sliding along said guide rails.

3. The fixture of claim 2 wherein said mounting means comprises body means secured to said pressure plate, said body means defining apertures for receiving said guide rails so as to slide along said guide rails.

4. The fixture of claim 3 wherein said body means at least partly encloses said lock plates.

5. The fixture of claim 4 further comprising bias means enclosed by said body means so as to bias said lock plates out of binding engagement with said guide rails.

6. The fixture of claim 1 wherein said operating shaft extends through said bar and includes a free end protruding beyond said bar, said fixture further comprising stop means to limit movement of said operating shaft so as to limit displacement of said bar.

7. The fixture of claim 6 wherein said operating shaft has a central axis and is mounted for rotation about said central axis, and said stop means includes protrusions extending from said bar adjacent said operating shaft to interfere with said operating shaft to limit rotation thereof.

8. The fixture of claim 1 further comprising a pad of resilient material covering said pressure plate.

9. The fixture of claim 1 wherein displacement of said operating shaft so as to bring the locking edges into binding engagement with the guide rails also displaces the pressure plate a preselected amount with respect to the guide rails as the locking edges are brought into said binding engagement.

10. The fixture of claim 1 wherein said pressure plate includes a central, generally planar body portion and a peripheral lip extending away from the body portion.

11. Clamping apparatus for mixing the contents of a closed container, comprising:

a pair of parallel spaced apart guide rails;

a frame supporting said guide rails;

12. The apparatus of claim 11 further comprising mounting means for mounting said pressure plate for sliding along said guide rails, said mounting means comprising body means secured to said pressure plate and defining apertures for receiving said guide rails so as to slide along said guide rails.

13. The apparatus of claim 12 wherein said body means at least partly encloses said lock plates.

14. The apparatus of claim 13 further comprising bias means enclosed by said body means so as to bias said lock plates out of binding engagement with said guide rails.

15. The apparatus of claim 11 wherein displacement of said operating shaft so as to bring the locking edges into binding engagement with the guide rails also displaces the pressure plate a preselected amount with respect to the guide rails as the locking edges are brought into said binding engagement.

16. The apparatus of claim 15 further comprising a pad of resilient material covering said pressure plate.

17. The fixture of claim 11 wherein said operating shaft extends through said bar and includes a free end protruding beyond said bar, said operating shaft having a central axis and being mounted for rotation about said central axis, and said fixture further comprising stop means to limit movement of said operating shaft so as to limit displacement of said bar, said stop means including protrusions extending from said bar adjacent said operating shaft to interfere with said operating shaft to limit rotation thereof.

18. Mixing apparatus for mixing the contents of a closed container, comprising:

an outer frame;

an inner frame disposed at least partly within the outer frame;

a pair of generally parallel spaced apart guide rails supported by the inner frame;

frame mounting means between the inner and outer frames for mounting the inner frame for mixing motion within the outer frame;

a motor mounted to the outer frame and coupled to the inner frame to move the inner frame with a mixing motion;

a pressure plate insertable between said guide rails;

at least two lock plates adjacent the pressure plate, one lock plate for each guide rail, each lock plate including an aperture for receiving a respective guide rail so as to slide along the guide rail, said aperture having a locking edge;

a bar extending between said lock plates, said bar having end portions for engaging said lock plates, with a central, cam-engaging portion therebetween;

an operating shaft movable between locked and unlocked positions, and having a cam mounting portion adjacent said central portion;

cam means mounted on the cam mounting portion and engaging the cam-engaging portion;

the cam-engaging portion of said bar including edge means defining an aperture for receiving the cam mounting portion of said operating shaft with said cam means engaging said edge means to displace said bar; and displacement of said operating shaft moving said cam to displace the bar and move the lock plates so as to bring the locking edges into binding engagement with the guide rails to prevent movement of the pressure plate with respect to the guide rails.

19. The apparatus of claim 18 further comprising plate mounting means for mounting said pressure plate for sliding along said guide rails, said plate mounting means comprising body means secured to said pressure plate and defining apertures for receiving said guide rails so as to slide along said guide rails.

20. The apparatus of claim 18 wherein said body means at least partly encloses said lock plates.

21. The apparatus of claim 20 further comprising bias means enclosed by said body means so as to bias said lock plates out of binding engagement with said guide rails.

22. The apparatus of claim 18 wherein displacement of said operating shaft so as to bring the locking edges into binding engagement with the guide rails also displaces the pressure plate a preselected amount with respect to the guide rails as the locking edges are brought into said binding engagement.

23. The apparatus of claim 22 further comprising a pad of resilient material covering said pressure plate.

24. The apparatus of claim 18 wherein said operating shaft extends through said bar and includes a free end protruding beyond said bar, said operating shaft having a central axis and being mounted for rotation about said central axis, and said fixture further comprising stop means to limit movement of said operating shaft so as to limit displacement of said bar, said stop means including protrusions extending from said bar adjacent said operating shaft to interfere with said operating shaft to limit rotation thereof.

25. The apparatus of claim 18 wherein said frame mounting means comprises a pivotal coupling between the inner and outer frames.

* * * * *